US009119281B2

(12) United States Patent
Chen et al.

(10) Patent No.: US 9,119,281 B2
(45) Date of Patent: Aug. 25, 2015

(54) CHARGED PARTICLE ACCELERATOR SYSTEMS INCLUDING BEAM DOSE AND ENERGY COMPENSATION AND METHODS THEREFOR

(71) Applicant: Varian Medical Systems, Inc., Paolo Alto, CA (US)

(72) Inventors: Gongyin Chen, Henderson, NV (US); Kenneth Todd Romriell, Las Vegas, NV (US); David Alan Howell, Las Vegas, NV (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 13/692,344

(22) Filed: Dec. 3, 2012

(65) Prior Publication Data

US 2014/0152197 A1 Jun. 5, 2014

(51) Int. Cl.
*H05H 7/00* (2006.01)
*H05H 7/02* (2006.01)

(52) U.S. Cl.
CPC ..... *H05H 7/02* (2013.01)

(58) Field of Classification Search
CPC ..... H05H 15/00; G01R 19/0061
USPC ..... 315/500–506
See application file for complete search history.

(56) References Cited

U.S. PATENT DOCUMENTS 5,010,562 A * 4/1991 Hernandez et al. ..... 378/125
5,401,973 A 3/1995 McKeown et al.
6,002,256 A * 12/1999 Slade ..... 324/322
6,462,489 B1 * 10/2002 Roberge et al. ..... 315/505
6,717,154 B2 * 4/2004 Black et al. ..... 250/393
7,507,977 B2 * 3/2009 Weiguo et al. ..... 250/492.21
7,566,887 B2 * 7/2009 Huang et al. ..... 250/492.21
8,111,025 B2 * 2/2012 Whittum et al. ..... 315/505
8,183,801 B2 5/2012 Chen et al.

(Continued)

OTHER PUBLICATIONS

Chen, Gongyin et al., "Dual-energy X-ray radiography for automatic high-Z material detection," Nuclear Instruments and Methods in Physics Research Section B: Beam Interactions with Materials and Atoms, vol. 261, Issues 1-2, Aug. 2007, pp. 356-359.

(Continued)

*Primary Examiner* — Douglas W Owens
*Assistant Examiner* — Srinivas Sathiraju
(74) *Attorney, Agent, or Firm* — Cozen O'Connor; Brandon N. Sklar

(57) ABSTRACT

A method of operating an acceleration system comprises injecting charged particles into an RF accelerator, providing RF power to the accelerator, and accelerating the injected charged particles. The accelerated charged particles may impact a target to generate radiation. The RF power is based, at least in part, on past performance of the system, to compensate, at least partially, for dose and/or energy instability. A controller may provide a compensated control voltage ("CCV") to an electric power source based on the past performance, to provide compensated electric power to the RF source. A decreasing CCV, such as an exponentially decreasing CCV, may be provided to the electric power source during beam on time periods. The CCV to be provided may be increased, such as exponentially increased toward a maximum value, during beam off time periods. The controller may be configured by a compensation circuit and/or software. Systems are also described.

29 Claims, 11 Drawing Sheets

(56) References Cited

U.S. PATENT DOCUMENTS

| | | | | |
|---|---|---|---|---|
| 8,232,747 | B2 * | 7/2012 | Crewson et al. | 315/505 |
| 8,472,583 | B2 * | 6/2013 | Star-Lack et al. | 378/57 |
| 8,598,813 | B2 * | 12/2013 | Joshkin et al. | 315/505 |
| 2008/0128641 | A1 | 6/2008 | Henley et al. | |
| 2008/0218102 | A1 | 9/2008 | Sliski et al. | |
| 2010/0001212 | A1 | 1/2010 | Nishiuchi et al. | |
| 2010/0038563 | A1 * | 2/2010 | Chen et al. | 250/503.1 |
| 2012/0200237 | A1 | 8/2012 | Torikai et al. | |
| 2012/0230471 | A1 * | 9/2012 | Chen et al. | 378/105 |
| 2012/0326636 | A1 | 12/2012 | Eaton et al. | |
| 2013/0106316 | A1 * | 5/2013 | Caporaso et al. | 315/506 |

OTHER PUBLICATIONS

Search Report and Written Opinion dated Mar. 31, 2014 issued in the International Patent Application No. PCT/US2013/072643.

* cited by examiner

CHARGED PARTICLE ACCELERATOR SYSTEMS INCLUDING BEAM DOSE AND ENERGY COMPENSATION AND METHODS THEREFOR

FIELD OF THE INVENTION

Charged particle accelerator systems and methods, more particularly, charged particle accelerator systems and methods including compensating for beam dose and energy instabilities by adjusting the electric power provided by an electric power source to an RF source and the resulting RF power provided to the accelerator.

BACKGROUND OF THE INVENTION

Radiation is widely used in interrogation and irradiation of objects, including people. Examples of interrogation include medical imaging, cargo imaging, industrial tomography, and non-destructive testing (NDT) of objects. Examples of irradiation include food irradiation and radiation oncology. Accelerated charged particles, such as protons, are also used in radiation oncology.

Radio-frequency ("RF") accelerators are commonly used to accelerate charged participles and to produce radiation beams, such as X-rays. RF accelerator based radiation sources may operate in a pulsed mode, in which charged particles are accelerated in short pulses a few microseconds long, for example, separated by dormant periods. Some applications require a "steady state" radiation beam, in which each pulse of radiation is expected to be the same. Other applications, such as cargo imaging, may use interlaced multiple energy radiation beams, as described, for example, in U.S. Pat. No. 8,183,801 B2, which was filed on Aug. 12, 2008, is assigned to the assignee of the present invention, and is incorporated by reference herein.

FIG. 1 is a block diagram of major components of an example of an RF accelerator system 10 configured to generate radiation. The system 10 comprises an accelerator (also called beam center line ("BCL") 12. An RF source 14, which may be a magnetron or a klystron, provides RF power to the accelerator 12, through an RF network 16. The RF network 16 ensures that the RF source 14 is properly coupled with the accelerator 12, and isolates the RF source from reflected RF power and the frequency pulling effect caused by the accelerator. The RF network 16 typically includes a circulator and an RF load (not shown). A charged particle source 18 injects charged particles into resonant cavities (not shown) of the accelerator 12, for acceleration. A target 20, such as tungsten, is positioned for impact by the accelerated charged particles, to generate radiation by the Bremsstrahlung effect, as is known in the art. To generate X-ray radiation, the charged particle source may include a diode or triode type electron gun, for example.

The RF source 14 is maintained in a "ready to generate" RF condition by a filament heater (not shown). The external surface of the RF source is usually temperature controlled. The charged particle source 18 also includes a filament heater (not shown) so that the particle source is ready to inject particles when requested.

An electric power source 22 provides electric power to the RF source 14 and the charged particle source 18. The electric power source 22 is controlled by a controller 24, such as a programmable logic controller, a microprocessor, or a computer, for example. An automatic frequency controller ("AFC") 26 is provided between the accelerator 12 and the RF source 14 to match the resonance frequency of the accelerator 12 with the frequency of the RF source, as described in U.S. Pat. No. 8,183,801 B2, identified above.

When a beam-on command is provided to the controller 24 by an operator to cause generation of a radiation beam, for example, the controller 24 enables the electric power supply 22 to provide electric power to the RF source 14 and to the charged particle source 18. The electric power may be provided in the form of pulses of a few microseconds each, at a rate of up to a few hundred pulses per second, for example. The accelerator 12 receives RF power from the RF source 14 and establishes standing or travelling electromagnetic waves in the resonant cavities of the accelerator, depending on the design of the accelerator. The resonant cavities bunch and accelerate charged particles injected by the charged particle source 18. In this example, accelerated charged particles are directed toward the target 20. Impact of the accelerated charged particles on the target 20 causes generation of radiation by the Bremsstrahlung effect, as mentioned above, at a corresponding radiation pulse length and rate. The electric power supply 22 is disabled and provides no pulsed electric power to the RF source when radiation is no longer needed (beam off). A beam-off command may be received from an operator or the controller may be programmed to end beam generation after a predetermined period of time. A beam run may last for seconds, minutes, or hours between a beam-on command and a beam-off command, for example. When radiation generation is desired again, the electric power supply is enabled and provides pulsed electric power to the RF source, again. Accelerated charged particles may also be used directly, in which case the target 20 is not necessary.

The stability of a generated radiation beam may vary from the beginning to the end of the radiation beam. See, for example, Chen, Gongyin, et. al., "Dual-energy X-ray radiography for automatic high-Z material detection," Nuclear Instruments and Methods in Physics Research Section B: Beam Interactions with Materials and Atoms Vol. 261, Issues 1-2, August 2007, pp. 356-359. FIG. 2 is a graph of normalized radiation dose versus time for a continuous radiation beam 2*a* generated for over 300 seconds by a Varian M6 Linatron®, available from Varian Medical Systems, Inc, Palo Alto, Calif. ("Varian"), based on actual test results. The steady state radiation beam 2*a* in this example comprises radiation pulses generated at a rate of several hundred pulses per second. Each pulse may last a few microseconds. These microsecond pulses are not indicated. In this example, the dose rate drops about 10% from a peak dose 2*b* at the very beginning of the radiation beam to a more steady dose rate after about 150 seconds. The energy of the radiation beam may vary, as well. Other commercially available linear accelerators may show instabilities similar to those shown in FIG. 2.

Some accelerators for medical applications available from Varian and other companies include a PFN servo, which adjusts the electric power provided by the electric power supply source 22 to the RF source 14 based on particle loss on a bending path of a radiation beam. Such feedback-based methods require high quality signals indicative of system status. They may also introduce oscillations in dose and/or energy due to back and forth adjustments in the electric power provided to the RF source.

SUMMARY OF THE INVENTION

While acceptable for many applications, variations in dose and energy can negatively impact results in applications that require more stable radiation dose and energy during the entire time the radiation beam is generated, starting from the initial generation of the radiation beam. In object and cargo imaging, for example, reliable material discrimination and/or identification require stable X-ray beam energy and dose output. In the case of interlaced energy radiation pulses, each pulse series needs to be stable. Due to radiation safety concerns and throughput requirements, it is not practical to turn the X-ray beam on, wait for it to stabilize, and then scan an object. In cancer therapy, there are also strict radiation beam quality (and quantity) requirements.

Various sources of potential instability may be present in an accelerator system. For example, it has been found that if the RF power has been off for long enough, the RF source reaches an RF-off thermal equilibrium state at a lower temperature than its RF-on thermal equilibrium state. After electric power starts to be provided to the RF source, it reaches an RF-on thermal equilibrium state. A rapid transition from the RF-off thermal equilibrium state to the RF-on thermal equilibrium state may cause RF output power and/or frequency to vary when the beam is first turned on, resulting in a change in radiation beam energy and dose output.

Another potential source of instability is the RF network, where insertion loss of the RF network components, primarily the RF circulator, may drift during similar transitions between thermal equilibrium states. Changes in insertion loss may lead to changes in RF power transmitted to the accelerator.

The accelerator is another potential source of instability, in part because the resonance frequency of the accelerator is susceptible to small temperature changes. As the accelerator is heated by RF power, it expands, causing slow frequency drift of the resonance frequency of the accelerator as the accelerator approaches thermal equilibrium. Such drift is most noticeable in the first minute or two of operation. The resonant frequency of the accelerator also varies in response to environmental changes, including ambient temperature. Changes in resonant frequency can cause a frequency mismatch with the RF source and RF network, increasing reflected RF power and weakening the electromagnetic field within the accelerator, resulting in reduced radiation beam energy. A frequency servo or automatic frequency controller ("AFC") is typically used to track the overall frequency shift of the accelerator resonant cavities. However, the AFC may not fully compensate for frequency shifts in individual cavities.

The charged particle source is another potential source of instability. The injection of charged particles into the accelerator may cool the charged particle source, while some charged particles may be forced back into the charged particle source by the accelerator, which may heat the charged particle source. Therefore, at the beginning of charged particle injection, the charged particle source also experiences a transition between thermal equilibrium states. This may change characteristics of the particle population pulled out of the source, such as their emittance characteristics (position and vector velocity at a given time), which may affect bunching and acceleration by electromagnetic field in the accelerator.

U.S. patent application Ser. No. 13/134,989, which was filed on Jun. 22, 2011, is assigned to the assignee of the present invention, and is incorporated by reference herein, describes techniques for preheating system components prior to radiation generation, to decrease the effects of temperature variation.

In accordance with embodiments of the invention, compensation is provided for dose and/or energy instability of a charged particle beam or a radiation beam based on past performance of an accelerator system. The compensation may be based on testing of the system in the factory before shipping and/or on-site. The compensation may be effectuated by adjusting the RF power provided to the accelerator, based on the past performance of the system. In one embodiment, the RF power is adjusted by adjusting the control voltage provided by a controller to an electric power source, which provides electric power to the RF source. The amount of compensation provided may decrease while charged particles are accelerated and/or a radiation beam is optionally generated, since less compensation is needed as system components approach their beam on thermal equilibrium states, during operation. The compensation may exponentially decrease, or decrease at other rates, during each beam on time period. A constant compensation may be provided, instead. The amount of compensation to be provided is a maximum after a cold start, where the system status has been beam off for long enough for system components have reached their beam off thermal equilibrium states. Typically, a change to a beam on status after the status of a system has been beam off for about 5-10 minutes can be treated as a cold start. The amount of compensation to be provided at the start of subsequent beam on time periods after the cold start may be less than the maximum compensation, as less compensation is needed. The amount of compensation to be provided at the start of subsequent beam on time periods may be determined by exponentially increasing the compensation level at the end of a respective prior beam on time period toward a maximum value, during the subsequent beam off time period. The compensation may be increased at other rates or at a constant rate, as well. The compensation may be provided by a circuit or may be determined by software, based on the past performance of the system. No feedback is required in embodiments of the present invention, although feedback may be provided in addition to the compensation provided in accordance with embodiments of the invention, if desired.

In accordance with an embodiment of the invention, a stabilized radio-frequency ("RF") accelerator system is disclosed comprising an RF accelerator to accelerate charged particles, an RF source coupled to the accelerator to provide RF power into the accelerator, and a charged particle source coupled to the accelerator to inject charged particles into the accelerator. An electric power source is coupled to the RF source and the charged particle source to provide electric power thereto. A controller is provided to control operation of the electric power source. The controller is configured to provide a compensated control voltage to the electric power source and the electric power provided to the RF source by the electric power source is based, at least in part, on the compensated control voltage. The compensated control voltage is based, at least in part, on past performance of the system. A target material may be positioned to be impacted by accelerated charged particles, to generate radiation.

The controller may be configured to determine a present compensated control voltage during a beam on time period by decreasing a prior compensated control voltage from a first value to the present compensation control voltage during a beam on time period, and the present compensated control voltage is provided to the electric power source during the beam on time period. The controller may be further configured to determine a present compensated control voltage during a beam off time period by increasing a prior compensated control voltage from a first value to the present compensation control voltage. The controller may be configured to determine the present compensated control voltage by retrieving a nominal control voltage stored by the system, and adjusting the retrieved value by a compensation value. A present compensation value may be determined by exponentially decreasing a prior compensation value to the present compensation value during a beam on time period and/or exponentially increasing the prior compensation value toward a maximum compensation value, to the present compensation value, during a beam off time period. A plurality of alternating beam on/beam off time periods may be provided in a scanning sequence.

The controller may be configured to determine the compensation value by a compensation circuit, which may comprise an R-C circuit comprising a capacitor and a resistor configured to allow the capacitor to discharge during the beam on time period. Exponentially decreasing present compensation values are thereby provided to the electric power source during beam on time periods, based, at least in part, on a respective current voltage of the capacitor during the beam on time periods. The compensation circuit may further comprises a second R-C circuit comprising the capacitor and a second resistor, configured to allow the capacitor to charge exponentially toward a maximum voltage during beam off time periods.

In one example, the compensation circuit further comprises a diode between the second resistor and the capacitor, and an input to provide a reference voltage to charge the capacitor through the second resistor and the diode during beam off time periods. A first ground is provided, to which the capacitor discharges, through the first resistor, during beam on time periods. An inverting attenuator is coupled to the capacitor to invert and attenuate the current voltage of the capacitor during the beam on time period. The present compensation value is the output of the inverting attenuator. A second ground is provided between the second resistor and the diode. The reference voltage is directed to the second ground, through the second resistor, during the beam on time period. The reference voltage in this example may be based, at least in part, on a pulse repetition frequency of a generated beam during the first and second beam on time periods.

A first switch may be provided to selectively couple the capacitor to the first ground through the first resistor during beam on time periods, so that the capacitor discharges to the first ground, and a second switch selectively directs the current in the second resistor (due to the reference voltage) to the second ground, during the beam off time period. The first switch and the second switch may be controlled by the controller. The first resistor and/or the second resistor may be variable resistors. The capacitor may be a variable capacitor, in addition to or instead of the first and/or second variable resistors. The first and second RC circuits have respective time constants based, at least in part, on the past performance of the system. The time constants may be set, at least in part, by setting the resistances of the first and second variable resistors, and/or the variable capacitor, respectively.

The controller may alternatively be configured to determine the present compensation value by software. The controller may be configured by the software to periodically adjust a nominal control voltage value by a compensation value. It is periodically determined whether the status of system is beam on or beam off. If the determined status is determined to be beam on, the prior compensation value is exponentially decreased to a present compensation value by an increment based, at least in part, on a time period and an instability time constant based, at least in part, on past performance of the system. If the determined status is determined to be beam off, the present compensation value is exponentially increased by an increment toward a maximum value, based, at least in part, on a time period and an instability time constant based, at least in part, on the past performance of the system.

The software may be configured to cause the controller to provide a maximum compensation value at a start of a first beam on period upon a cold start and determine the present compensation value by exponentially decreasing the maximum compensation value to the present compensation value.

In accordance with another embodiment of the invention, a method of operating a charged particle acceleration system is disclosed comprising injecting charged particles into an RF accelerator, and providing RF power to the accelerator based, at least in part, on past performance of the system, to compensate, at least in part, for dose and/or energy instability. The method further comprises accelerating the injected charged particles by the accelerator. The RF power provided to the accelerator may be based, at least in part, on compensated electric power that is based, at least in part, on the past performance of the system.

In accordance with another embodiment of the invention, a charged particle acceleration system is disclosed comprising accelerator means for accelerating charged particles, means for injecting charged particles into the accelerating means, and RF power means for providing RF power to the acceleration means based, at least in part, on past performance of the system, to compensate, at least in part, for dose and/or energy instability. Electric power means is provided for providing electric power to the RF power means. The method further comprises accelerating the injected charged particles by the accelerator means. The electric power means may provide electric power to the RF power means based, at least in part, on the past performance of the system and the RF power provided to the accelerator means by the RF power means is based, at least in part, on the electric power provided by the electric power means.

It is noted that when a radiation scanning system is said to have a "beam on" status during a "beam on time period," the term "beam on" may refer to the acceleration of charged particles for direct use, or for the generation of an X-ray radiation beam by impact of the accelerated charged particles on an appropriate target, such as tungsten, for example. The term "beam on" refers to a continuous or pulsed beam of charged particles or a continuous or pulsed beam of radiation.

DESCRIPTION OF THE PREFERRED EMBODIMENTS

Figure 3:
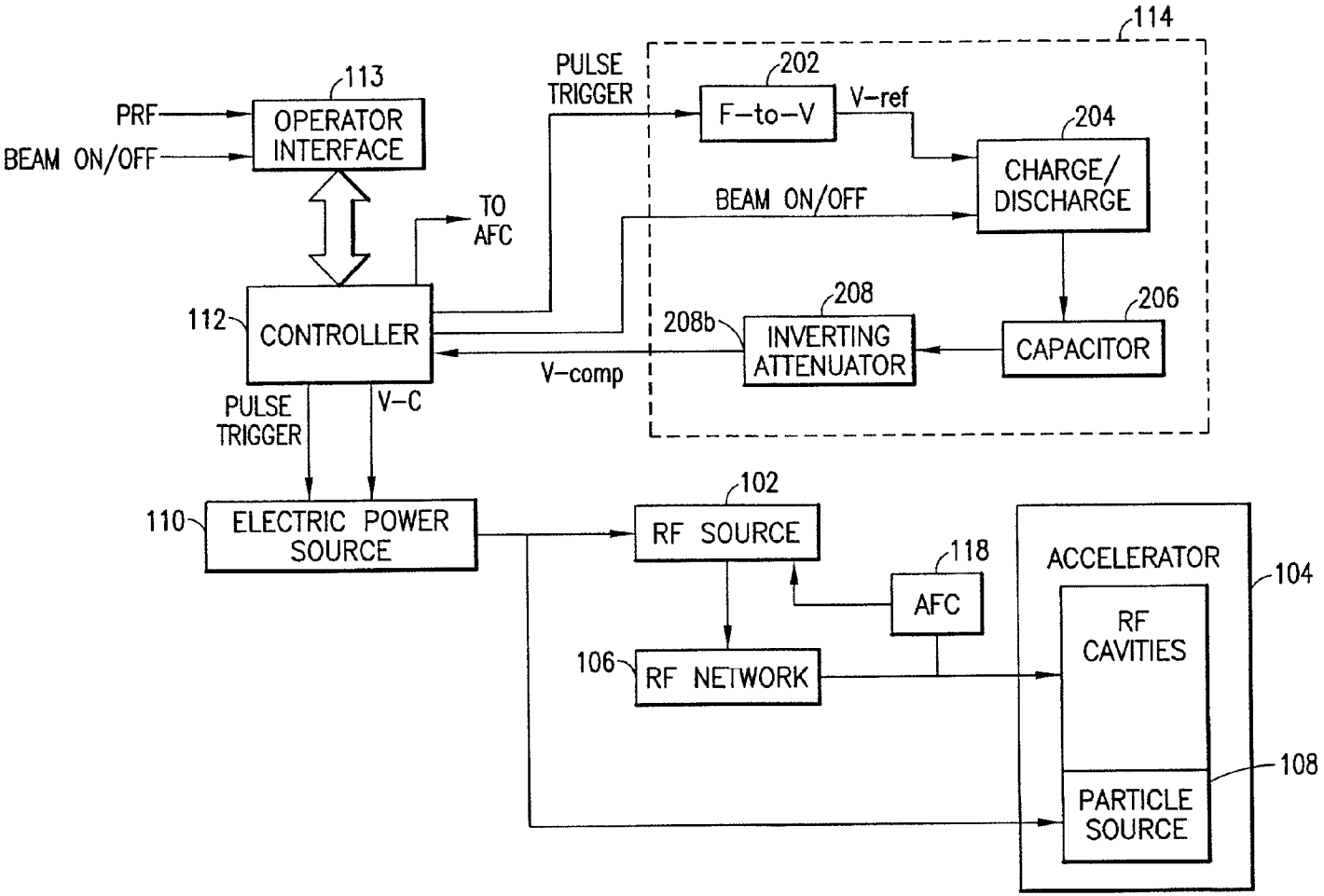
FIG. 3 is an example of an RF accelerator system configured to generate radiation beams with improved stability, in accordance with an embodiment of the invention.

FIG. 3 is an example of an RF accelerator system 100 configured to generate charged particle beams and radiation beams with improved stability, in accordance with one embodiment of the invention. In this example, an RF source 102 provides RF power to an RF accelerator 104 through an RF network 106, and the charged particle source 108 injects charged particles to the accelerator, as described above. An electric power source 110 provides electrical power to the RF source 102 and to the particle source 108. A controller 112, such as a programmable logic controller, a microprocessor, or a computer, for example, controls the electric power source 110 by providing a pulse trigger and a control voltage V-C to the electric power source, in response to input signals from an operator via an operator interface 113 and/or programming. The electric power source 110 generates electric power based on the control voltage V-C, at times and at a rate determined by the trigger. In accordance with this embodiment of the invention, an electric power compensation circuit 114 is provided to compensate for instabilities in dose and/or energy by adjusting the electric power provided by the electric power source to the RF source 102. In the example of FIG. 3, the circuit is between the controller 112 and the electric power source 110. In one alternative, the circuit 114 may be part of the controller 112.

Figure 10:
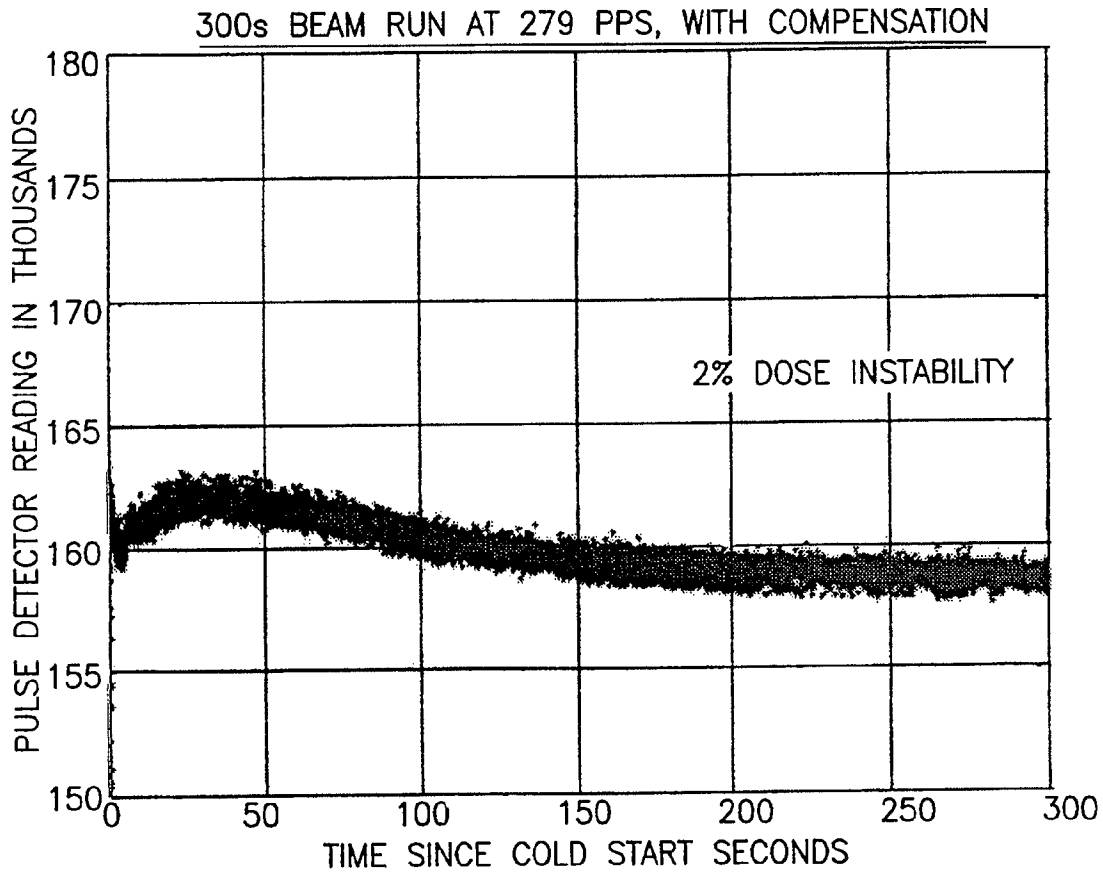
FIG. 10 shows the radiation dose instability of an accelerator system that included the compensation circuit of FIGS. 4 and 5, during a 30 second beam on time period after a cold start.

The accelerator 104 accelerates charged particles, which may be used directly or may be used to impact a target (not shown in this view for ease of illustration) to cause generation of radiation, if desired. The target may comprise tungsten or other materials that will cause generation of X-ray radiation by the Bremsstrahlung effect upon impact by the charged particles, such as electrons, accelerated by the accelerator 104. A target is shown in FIG. 10. The RF accelerator 104 may be a linear accelerator comprising a plurality of electromagnetically coupled resonant cavities (not shown), such as a Linatron® available from Varian Medical Systems, Inc., Palo Alto, Calif. The RF accelerator 104 may be another type of accelerator that uses RF power to accelerate charged particles, such as a cyclotron, as well. The RF source 102 may comprise a klystron or a magnetron. The charged particle source 108 may be an electron gun, such as a diode or triode type electron gun, as discussed above, for example.

Figure 4:
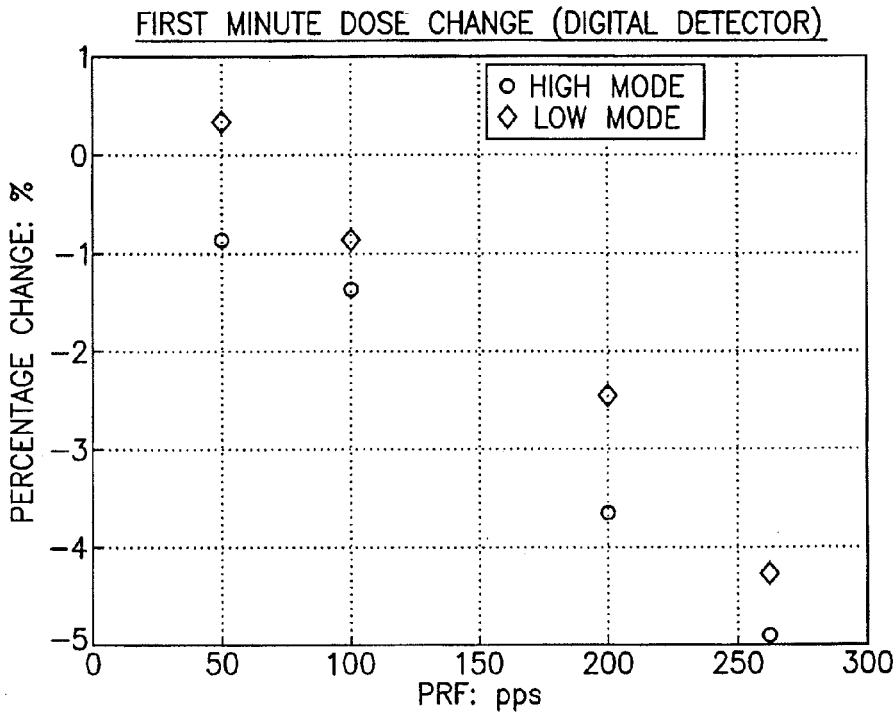
FIG. 4 is a graph of dose change (in percent) versus pulse repetition frequency in pulses-per-second.

The electric power source 110, also referred to as a modulator, may comprise a high voltage power supply ("HVPS"), a pulse forming network ("PFN"), and a thyratron, which are not shown in FIG. 4. One or more transformers (not shown) may be provided, as well. Electric power supplies are described in more detail in U.S. Pat. No. 8,183,801 B2, which is assigned to the assignee of the present invention and is incorporated by reference herein. In one example, the HVPS outputs 22,000 volts, which is increased to about 40,000 volts by the transformer and provided to the RF source 102, as described in U.S. Pat. No. 8,183,801 B2. The electric power source 110 may also comprise a solid state modulator, for example.

Automatic frequency controller ("AFC") 118 may also be provided between accelerator 104 and the RF source 102, under the control of the controller 112 or other such controller, as discussed above with respect to FIG. 1. The AFC 118 samples RF signals that go to and are reflected from the accelerator 104, to detect the frequency matching condition and adjust the frequency of the RF source 102, if necessary, to match the resonant frequency of the accelerator. The RF signal may be sampled between the RF source 102 and the circulator (not shown) in the RF network 106, instead. The sampling times may be controlled by the controller 114 or other such controller, for example. The AFC 118 may be based on a quadrature hybrid module and an adjustable phase shifter, which are commercially available. AFCs and their operation are described in more detail in U.S. Pat. No. 8,183,801 B2 and U.S. Pat. No. 3,820,033 which are assigned to the assignee of the present invention and are incorporated by reference herein.

In the example of FIG. 3, the electric power compensation circuit 114 comprises a frequency-to-voltage ("F-to-V") converter 202, a charge/discharge circuit 204, a capacitor 206 having a capacitance C, and an inverting attenuator 208. The charge/discharge circuit 204 and the capacitor 206 form two switched RC circuits, as shown and described in more detail with respect to FIG. 5, below. In this example the electric power compensation circuit 114 provides an adjustment to the control voltage V-C provided by the controller 112 to the electric power source 110, to compensate for the difference between the desired target dose and/or energy of an accelerated charged particle beam or radiation beam generated by the system 100 and the expected dose and/or energy without compensation due to instabilities, at a point in time. The expected dose and/or energy without compensation may be determined based on past performance of a particular system 100 in the factory and/or on-site, which is discussed further, below. The adjustment provided at a point in time is based on (proportional to) the voltage of the capacitor 206 at that point in time. The voltage of the capacitor 206 decreases as the capacitor discharges over the course of respective beam on time periods, as less compensation is needed. The capacitor 206 charges during respective beam off time periods so that it will be at an adequate voltage level to compensate for instabilities in beam on time periods following the respective beam off time periods. The frequency of the pulse trigger is converted to a voltage by the F-to-V converter, providing a reference voltage V-ref to the charge/discharge circuit 204, to charge the capacitor 206.

It has been found by the inventors that in certain accelerator systems, the amount of dose energy instability may be related, in part, to the pulse repetition frequency (and hence the duty cycle). FIG. 4 is a graph of dose change (in percent) versus pulse repetition frequency ("PRF") in pulses-per-second ("PPS"), as measured by a digital detector, for high energy pulses (nominally 6 MV) and low energy pulses (nominally 4 MV) by a Varian Linatron® X-ray system. The greater the PRF, the greater the percentage change in dose and/or energy.

In the present example, if the PRF of the scanning sequence is high, more compensation is needed and a higher frequency pulse trigger is provided to the F-to-V converter, than if the PRF is lower. The higher frequency pulse trigger results in a higher V-ref that will be provided to the capacitor 206, increasing the final voltage to which the capacitor is charged, and providing a more negative compensation signal V-comp, providing more compensation during the next beam on time period. In this example, when it is known that dose/energy stability is related to PRF, the controller 112 provides a pulse trigger to the F-to-V convertor 202 that is proportional to the PRF of the current scanning sequence, at the same times and for the same lengths of time as the pulse trigger is provided to the electric power source 110. If it is found during factory and/or on-site testing that the PRF of a scanning sequence does not have an impact on dose/energy instability of a particular system 100, then an appropriate pulse trigger to cause generation of an appropriate V-ref to charge the capacitor 206 to an appropriate level is provided.

The controller 112 provides a control signal, referred to as the Beam On/Off signal, to the charge/discharge circuit 204 to control when the capacitor 206 is discharged and charged. When the status of the system 100 is beam on, the capacitor 206 is discharged to provide the compensation signal V-comp. When the status of the system is beam off, the capacitor 206 is charged to an appropriate level so that it will provide an appropriate V-comp when the status of the system is beam on again.

The voltage output of the charge/discharge circuit 204 is provided to the inverting attenuator which inverts the voltage. The inverted voltage is provided to the electric power source 110 as the compensation signal V-comp to the control voltage provided to the electric power source 110, to decrease or increase the control voltage, as appropriate.

The electric power compensation circuit 114 is configured to provide greater compensation V-Comp when the accelerator has been off for longer periods of time, when more compensation is needed. This is because it has been found by the inventors that the difference between the target dose and/or energy and the expected dose and/or energy is highest after the system 100 is turned on after about 5 or 10 minutes of being off, since system components will have typically cooled to their off equilibrium state by then. This is therefore referred to as a cold start, where the most compensation for instabilities is needed. Less compensation is needed as the system 100 continues to operate, because the system 100 warms up and system components approach their equilibrium temperatures. Similarly, less compensation is needed when the system 100 is started after being off for less than about 5 minutes or 10 minutes (non-cold start), because components will not have cooled to their equilibrium off states by then. The amount of time an accelerator system 100 is off before components will cool to their equilibrium off states may vary depending on the system 100 and the environment in which it operates, for example.

Figure 5:
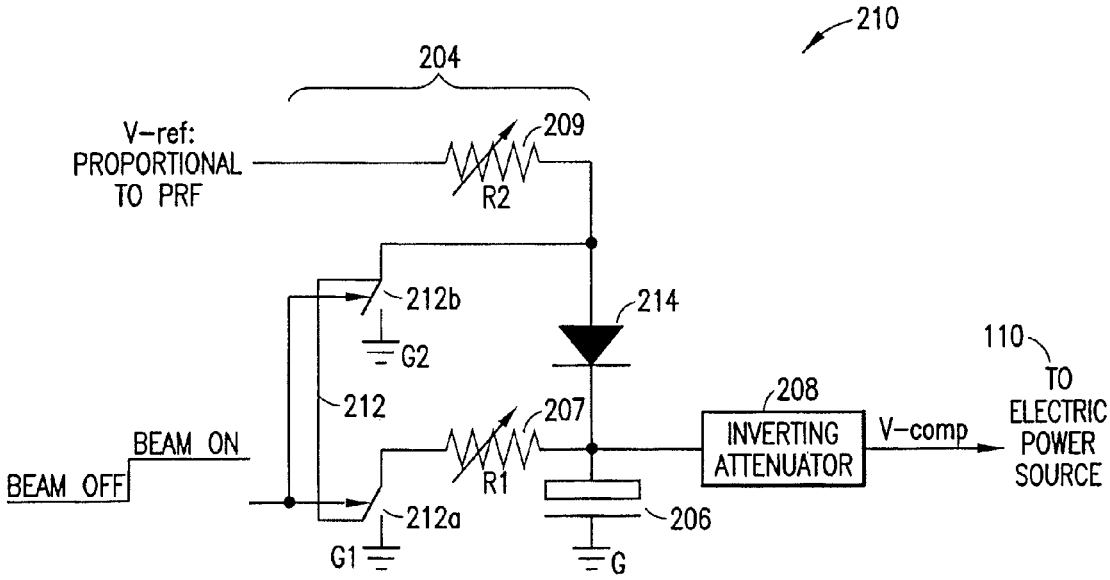
FIG. 5 is an example of a compensation circuit that may be used in the example of FIG. 3.

FIG. 5 is a schematic diagram of the compensation circuit 210 comprising the charge/discharge circuit 204 and the capacitor 206 of FIG. 3. The inverting attenuator 208 of FIG. 5 is also shown. The bottom electrode of the capacitor 206 is connected to ground G. The charge/discharge circuit 206 comprises a discharge portion and a charge portion. The discharge portion comprises a first resistor 207 having a resistance R1, which in this example is a variable resistor, a switch 212*a*, and a ground G1. The resistor 207 is between the switch 212*a* and the capacitor 206. The switch 212*a* selectively couples and decouples the resistor 207 to a ground G1, under the control of the Beam On/Off signal from the controller 112, noted above with respect to FIG. 3. While the status of the system 100 is beam on (electric power is provided to the RF source 102, so that RF power is provided to the accelerator 104 to accelerate charged particles by the accelerator 104), the switch 212*a* is closed, electrically coupling the resistor 207 to the ground G1. The capacitor 206 therefore discharges to ground G1 at a time constant R1C. While the status of the system 100 is beam off, the switch 212*a* is open, decoupling the resistor 207 from the ground G1, so that the capacitor 206 cannot discharge to the ground G1.

The charge portion of the circuit 204 comprises a second switch 212*a*, a second resistor 209 having a resistance R2, which in this example is also a variable resistor, coupled to the capacitor 206 via a diode 214. The diode 214 may have a small forward junction voltage. The voltage V-ref is provided to the resistor 209. A ground G2 is provided parallel to the diode 214 and the capacitor 206. The capacitor 206 is electrically coupled in parallel to the second resistor 209 and the inverting attenuator 208. While the status of the system is beam off, the second switch 212*b* is closed, electrically coupling the resistor 209 to the capacitor 206 through the diode 214, charging the capacitor 206 at a time constant R2C. While the status of the system 100 is beam on, the switch 2121*b* is closed, coupling the resistor 209 to the ground G2 and shunting the current in the resistor 209 (due to V-ref) to the ground G2. The switches 212*a*, 212*b* may be separate switches, or may be separate arms of a double arm switch 212, as shown schematically in FIG. 3.

The voltage V-comp is inversely proportional to the degree the capacitor 206 has been charged, because the inverting attenuator 208 reverses the polarity of the voltage of the capacitor 206. When the status of the accelerator 104 has been beam off for an extended period of time, such as from about 5 to about 10 minutes or more (cold start), the capacitor 206 has time to fully charge at the time constant R2C. Then, when the status of the system is changed to beam on, the output of the capacitor 206 will be at a maximum voltage, V-comp will provide maximum compensation to electric power source 110, and the capacitor discharges at the time constant R1C. The voltage of the capacitor 206 will decrease as the capacitor discharges while the status of the system 100 remains beam on, providing a less negative V-comp as less compensation is needed. When the accelerator 104 is off for shorter periods of time, the capacitor 206 may fully charge or only partially charge, depending on how long the status of the system 100 has been beam off. The time constant R1C of the discharge RC circuit and time constant R2C of the charge RC circuit may be adjusted to match the performance of a particular accelerator system 100, as determined during factory and/or on-site testing.

During operation, the F-to-V converter 202 receives a pulse trigger from the controller 112. In this example, the pulse trigger has a frequency proportional to the PRF. The PRF may be selected by an operator and provided to the controller 112, or determined by a software program controlling the controller 112, for example. The corresponding pulse trigger is determined by the software controlling the controller 112. V-ref, which in this example is the output of the F-to-V converter discussed above with respect to FIG. 5, is provided to the variable resistor R2.

While the controller 112 provides a signal indicating that the system 100 has a beam off status, the switches 212*a*, 212*b* are in an opened state, allowing the V-Ref voltage to be provided to the capacitor 206 through the variable resistor 209 and the diode 214, charging the capacitor at a time constant R2C. Since the switch 212*a* is open, the capacitor 206 cannot discharge to the ground G1. If the status of the system 100 remains beam off long enough, the capacitor 206 will fully charge, providing maximum compensation (maximum V-comp) the next time the status of the system 100 changes to beam on, which may be a cold start. If the status of the system 100 has not been beam off for long enough for the start to be a cold start, the capacitor 206 will have only partially charged, providing less than maximum compensation (V-comp) when the system changes status from beam off to beam on.

When the controller 112 provides a signal indicating that the beam status has changed from beam off to beam on, the switches 212*a*, 212*b* both close. Closing of the switch 212*b* shunts the current going through R2 (due to V-ref), to the ground G2. The diode 214 is reversely biased and not conducting. Closing the switch 212*a* causes the capacitor 206 to discharge to ground G1 through the first resistor 207, at a time constant R1C. In addition, the inverting attenuator 208 receives a voltage on its input 208*a* from the discharging capacitor 206. As the capacitor 206 discharges, the voltage of the capacitor, and the voltage on the input 208*a* of the inverting attenuator 208, decrease. Discharge of the capacitor 206 thereby results in decreasing compensation V-comp during the beam on time period. This is desired because less compensation is needed as the status of the system remains beam on, as system components warm up an approach their thermal equilibrium temperatures. The inverting attenuator 208 decreases the received voltage and reverses its polarity, providing a negative voltage V-comp at its output 208*b* to the controller 112. As the capacitor 206 discharges, the V-comp signal becomes less negative.

The controller 112 stores a predetermined nominal control voltage. In an uncompensated system, such as system 10 shown in FIG. 1, the predetermined nominal control voltage is provided by the controller 24 to the electric power source 110 to cause generation of electric power to be provided to the RF source 14. In the compensated system 100 of FIGS. 4 and 5, in contrast, the controller 112 adjusts the predetermined, nominal control voltage stored in the controller by V-comp to yield a compensated control voltage V-C to be provided to the electric power source 110. For example, the compensated control voltage V-C may be the sum of the nominal control voltage and V-comp. Since V-comp is negative in this example, the compensated control voltage V-C will be equal to the nominal voltage minus the absolute value of V-comp. The compensated control voltage V-C may be calculated by another processing device (not shown) between the inverting attenuator 208 and the controller 110 or the controller and the electric power source 110, for example. These calculations may be performed by software stored in or associated with the controller 110, or by an application specific integrated circuit (ASIC), for example.

As noted above, the amount of dose and energy instability may be related to the PRF. This may be determined during testing in the factory and/or on-site. The inverting attenuator 208 is provided because, in order for the voltage of the capacitor 206 to be proportional to the PRF, V-ref must be larger than the forward voltage (voltage drop in conduction) of the diode 214. But the adjustment to the control signal V-comp itself needs to be small. The inverting attenuator 208 is therefore provided to lower the voltage of the capacitor 206.

Figure 2:
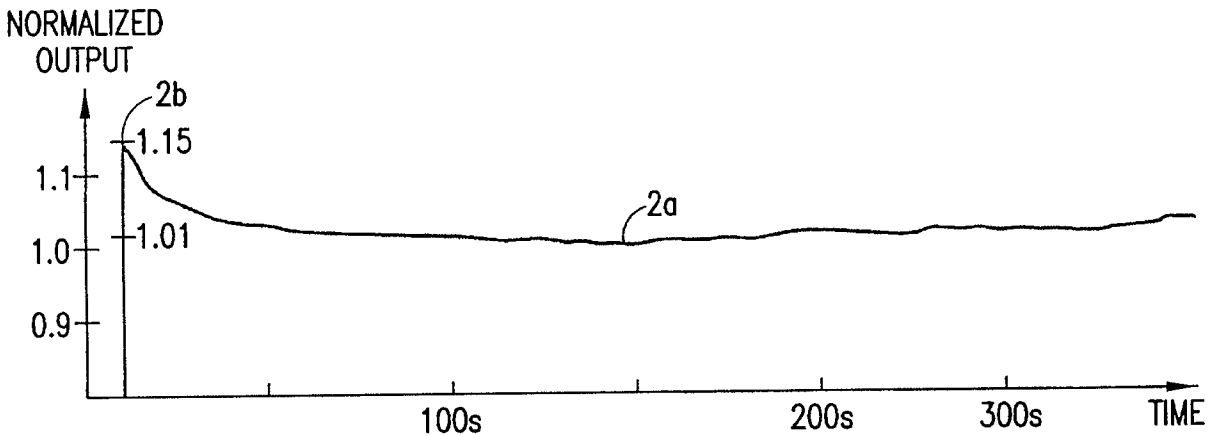
FIG. 2 is a graph of normalized radiation dose versus time for a continuous radiation beam generated by an RF accelerator.

The appropriate discharge time constant R1C and the appropriate charge time constant R2C of the compensation circuit 204 for a particular system 100 may be determined by analyzing the dose and/or energy performance of the system 100 during varying scanning sequences and PRFs, by testing the system 100 in the factory and/or on-site. As shown in FIG. 2, the dose and/or the energy will stabilize over time to a steady state value. A time constant for the rate of stabilization (discharge time constant R2C) is set to match the time constant of the dose/energy instability, by a technician in the factory and/or on-site, based on data collected from the system during test runs. The data may be plotted, as shown in FIG. 2, and the time constant determined from the plot, for example. The collected data may also be analyzed directly by a computer or other processing device to determine the time constants, without plotting the data.

The time constant of the curve may be used in the circuit of FIGS. 4 and 5, for example, by suitably setting the variable resistor R1 to set the discharge time constant R1C. The charge time constant R2C is set to sufficiently charge the capacitor 206 to provide sufficient compensation after a particular beam off time period. Typically, the same time constants R1C, R2C will be applicable to different beam off time periods, PRFs, and scanning sequences, in a particular system 100. The discharge and charge time constants may be adjusted independently, or the charge time constant R2C may be the same as the discharge time constant R1C. If the capacitor 206 is a variable capacitor, the capacitance may be varied to achieve the desired time constant instead of or along with changing the resistance of the variable resistor R1 and/or R2.

In one example, the variable resistors R1 and R2 are adjustable over a range of from 0 to 20 Kohms to provide a desired time constant for the charging and discharging of the capacitor 206. The capacitor 206 may have a capacitance of 2200 microfarads, and the inverting attenuator 208 may have a ratio of about 1 to −0.05, for example. The F-to-V converter may have a ratio of 100 pulses per second ("pps") to 1 volt, for example. The reference voltage needs to be greater than the diode voltage, which in this example is 0.3 volts. The diode 214 may be a Schottky type diode with a forward junction voltage of about 0.3V, for example. In this example, the electric power adjustment circuit 114 was calibrated at a PRF of 279 pps (V-ref=2.79 V), and set the attenuation of the inverting attenuator 208 so that when the capacitor 206 was fully charged to 2.79 V, V-comp had an amplitude of −152 mV. This V-comp provided a maximum adjustment to the nominal voltage in the controller 112 of about 2%. This is sufficient to reduce a dose/energy instability of about 6% to 8%, which is too large for many applications, to about 2% to 3%, which is acceptable for many applications. At a lower PRF, a lower V-ref is needed and the maximum amplitude of V-comp would be proportionally smaller. These values are only exemplary. Other values for these components may be provided. Each accelerator 110 may require different compensation.

Figure 6:
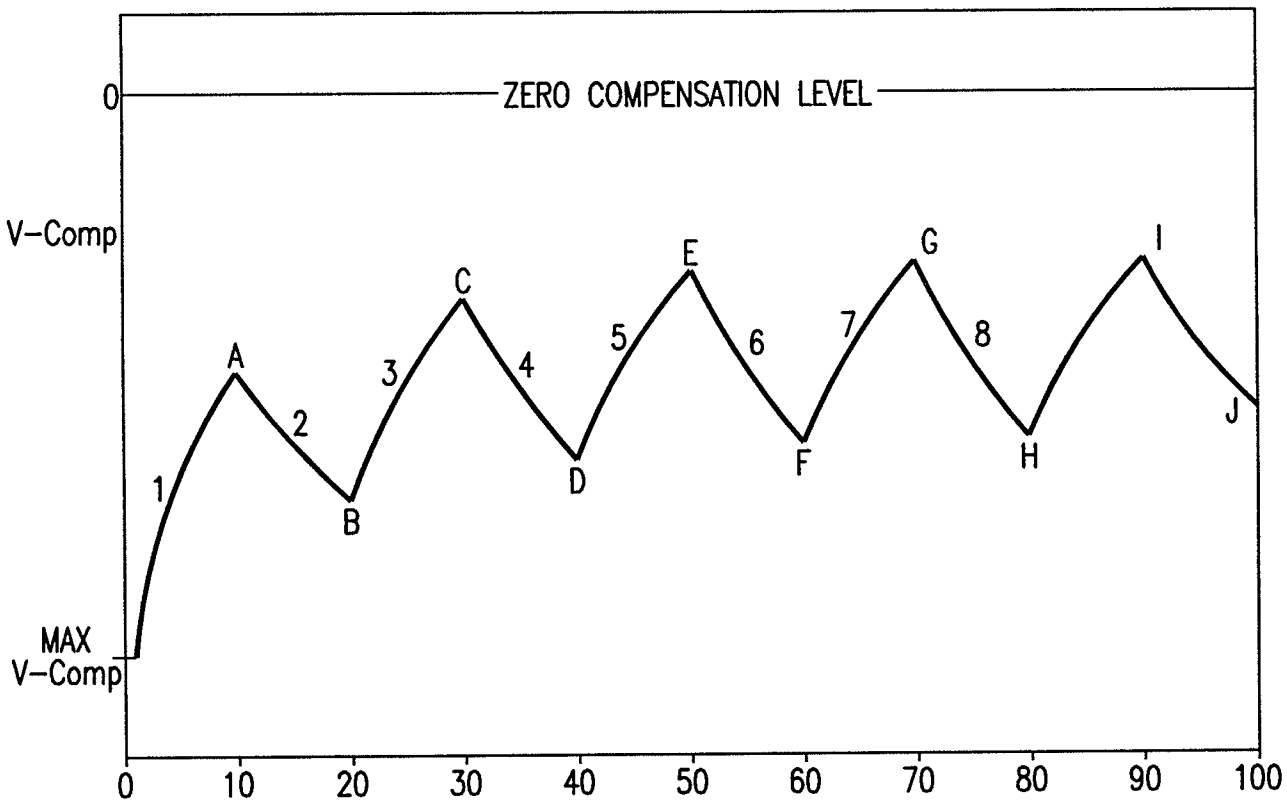
FIG. 6 is an example of a V-comp signal provided during an on/off cycling scanning sequence after a cold start, in accordance with an embodiment of the invention.

FIG. 6 is a graph of an example of the operation of the compensation circuit 114 of FIGS. 4 and 5, showing how V-Comp varies over time during operation of an accelerator 104 that is cycled on and off every 10 seconds, after a cold start. As above, PRF was 279 pps, V-ref was 2.79 V, and maximum V-comp was −152 V. Each horizontal division is 10 seconds. The vertical axis is V-comp in millivolts (mV). The Maximum V-comp of −152 V was provided after the cold start, when the capacitor 206 was fully charged and the most compensation was needed. The maximum V-comp in this example has the most negative value in FIG. 6 because the inverting attenuator 208 inverts the voltage provided by the capacitor 206 to a negative value, as discussed above.

In the example of FIG. 6, in the first few beam on time periods (legs 1, 3, and 5, for example), V-comp has progressively less negative starting values, because the capacitor 206 charges to progressively lower voltages during the previous beam off period (cold start, legs 2, 4, and 6, for example). Similarly, in those first few beam on periods (legs 1, 3, and 5, for example), V-comp has progressively less negative starting and ending values, because the capacitor 206 discharges to lower voltages and is then charged to lower voltages. Since the system 100 does not fully cool off during the short beam off time periods in this example (legs 2, 4, and 6, for example), progressively less compensation is needed each time the system 100 status is changed from beam off to beam on. After additional beam on/off cycles, the charging and discharging levels approach respective steady state levels over subsequent cycles.

In particular, in this example, at time 0 the system 100 changes to a beam on status after being in a beam off state for an extended period of time, such as at least 5 to 10 minutes, for example. This is a cold start; maximum compensation for instabilities is therefore required, and capacitor 206 has had time to fully charge. At time 0 Max V-comp of −152 mV was provided to the electric power supply 112 to compensate for instabilities. From 0 seconds to 10 seconds the system 10 is in a beam on status, switches 212*a* and 212*b* are closed, current in the resistor R2 is shunted to ground G2 and the diode 214 is reverse biased and not conducting. The capacitor 206 discharges to ground G1 with a time constant R1C, while providing a decreasing (less negative) V-comp to the inverting attenuator 208, to a charge level A of −76 V.

At 10 seconds the status of the system 10 is changed to beam off and the switches 212*a* and 212*b* are opened. Current is provided through the resistor R2 and the diode 214 to the capacitor 206, charging the capacitor, for 10 seconds. There is no discharging current through R1. Since the system 100 had already been on for 10 seconds, it had time to warm up to some extent. Maximum compensation will not, therefore, be required the next time the system status is changed to beam on, which in this scanning sequence will take place at 20 seconds. The compensation circuit 210 is configured by suitable setting of the time constant R2C so that the capacitor 206 will only charge to V-comp level B of −112 V during the 10 seconds the system status is beam off.

At 20 seconds, the system 100 status changes to beam on, the switches 212*a*, 212*b* are closed, current through R2 is shunted to ground G2, and the diode 214 is reverse biased and not conducting. The capacitor 206 discharges through R1 to ground G1 with the time constant of R1C, starting from V-comp level B, generating a decreasing V-comp signal over the next 10 seconds, until the status of the system changes to beam off at 30 seconds. Discharging continues for 10 seconds, during which time the capacitor 206 discharges to V-comp level C, which is less negative than V-comp level A.

At 30 seconds, when the system status changes to beam off, the switches 212*a*, 212*b* are open and the capacitor 206 charges to V-comp level D over the next 10 seconds. V-comp level D is less negative than V-comp level B. When the system status is changed to beam on at 40 seconds, the capacitor 206 starts discharging from V-comp level D to V-comp level E, which is less negative than V-comp level C.

In this example, during each beam on period, the starting V-comp levels (Max V-comp, V-comp levels B, D) and the ending V-comp discharge levels (V-comp levels A, C) converge toward a steady state starting V-comp level F and steady state ending V-comp level E, so that in subsequent time periods, the starting V-comp levels G and I return to or nearly return to V-comp level E, and the ending V-comp level H returns to or nearly returns to V-comp level F. This continues while the beam on/off sequence continues. While in this example the charge/discharge level approached the steady state levels after about 50 seconds, other systems, accelerators, and/or other beam on/off timing sequences may approach steady state after different periods of time. When the system 100 is in beam off status for from 5 minutes to 10 minutes, the system 100 will return to an off thermal equilibrium state. The capacitor 206 will have time to fully charge to Max V-comp, so that maximum compensation will be provided on the cold start.

Figure 1:
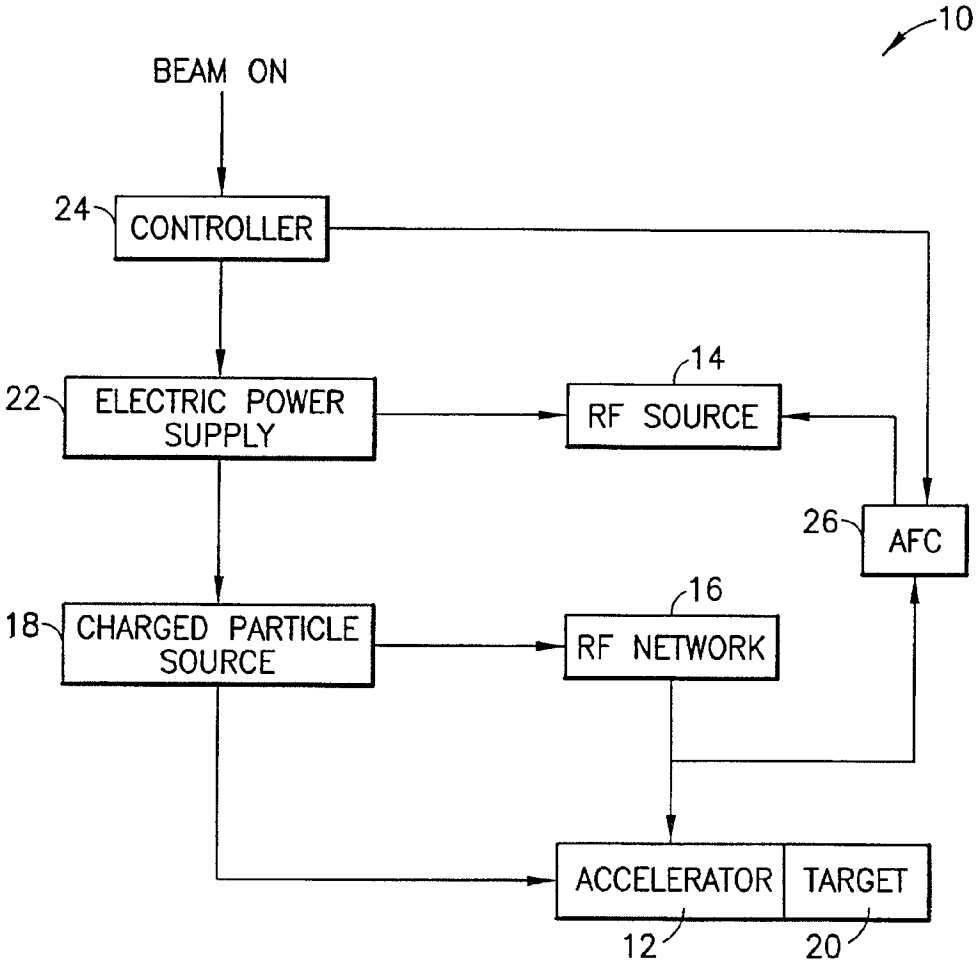
FIG. 1 is a block diagram of major components of an example of an RF accelerator system configured to generate radiation.
Figure 7:
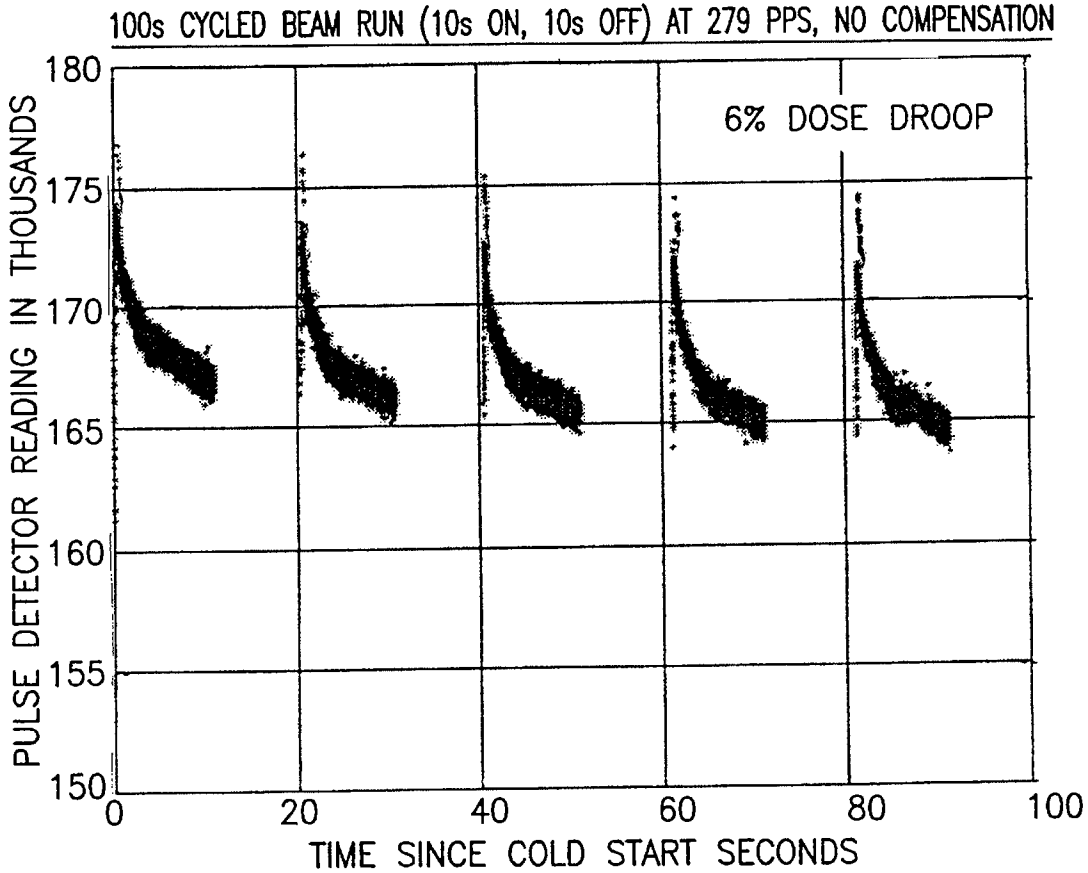
FIG. 7 is an example of the instability of the radiation beam generated during a scanning sequence as in FIG. 6.
Figure 8:
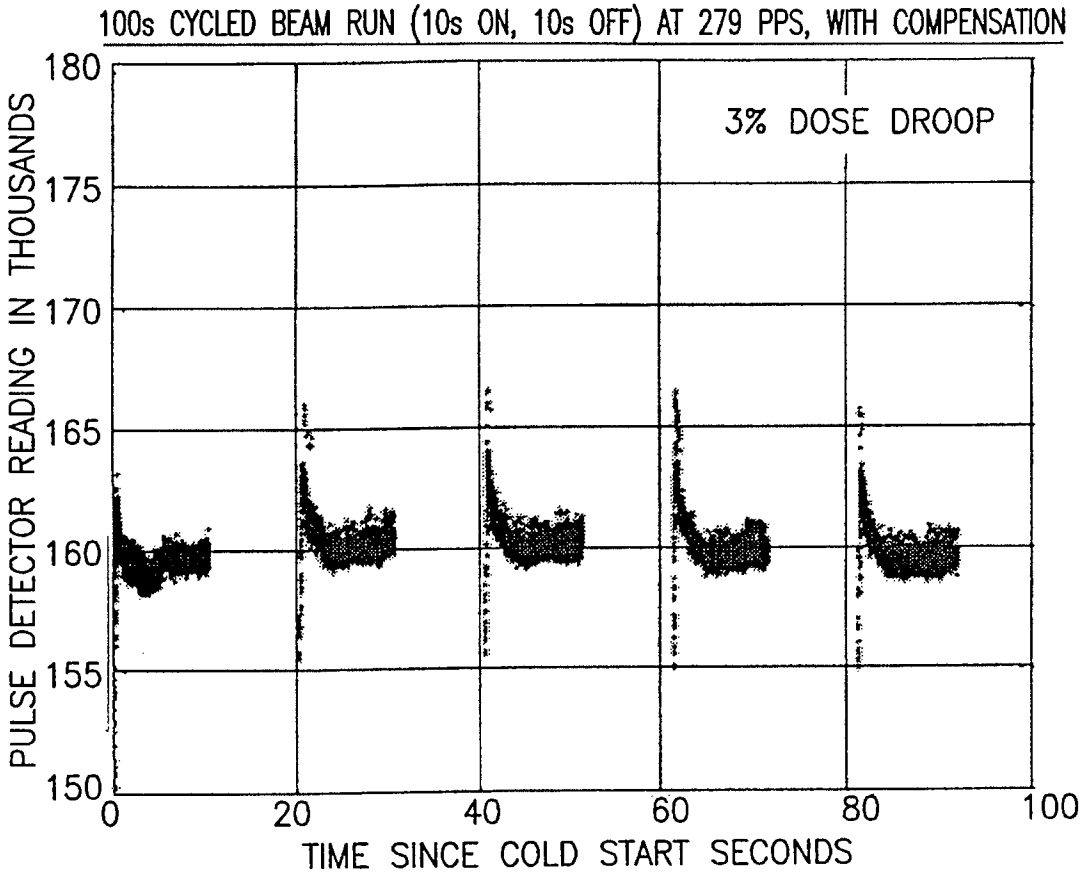
FIG. 8 shows the instability of an accelerator system that included the electric power compensation circuit of FIGS. 3 and 5, during a plurality of cycles of the same sequence as in FIG. 7.

FIG. 7 is an example of the instability of a radiation beam generated by the radiation scanning system 10 of FIG. 1, without compensation, during a scanning sequence, in which the system status is changed from beam on and beam off every 10 seconds after a cold start, as in FIG. 6. Each cycle shows an instability from the peak radiation at the beginning of each beam on period of about 6%, which may not be acceptable in many applications. It is noted that the peak radiation also decreases from one cycle to the next cycle, as the system 10 warms up. The minimum radiation in each cycle also drops for the same reason. The difference between the peak radiation dose and the minimum is about 6% in the first beam on period, and decreases somewhat from cycle to cycle as the system 10 warms up. FIG. 8 shows the instability of the accelerator system 100 including the electric power compensation circuit 114 of FIGS. 4 and 5, during a plurality of cycles of the same sequence as in FIG. 7. Here, the dose instability was only about 3%, which is acceptable for most applications.

Figure 9:
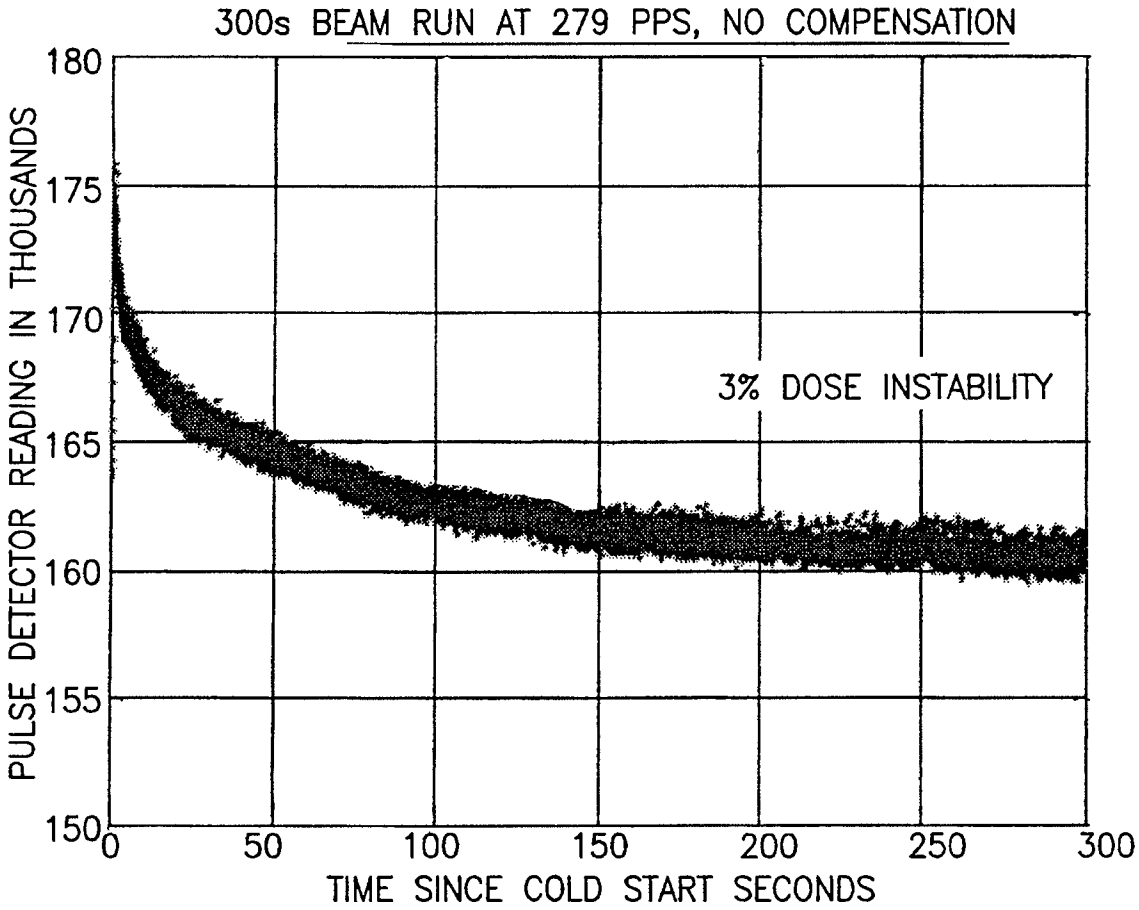
FIG. 9 shows the radiation dose instability of a radiation beam during a 300 second beam on time period after a cold start, in an accelerator system such as that shown in FIG. 1.

Similar improvement was shown in longer beam runs. FIG. 9 is another example of radiation dose instability of a 300 second radiation beam after a cold start, in the system 10 such as that shown in FIG. 1, without compensation. The difference between the initial radiation dose of about 173 and the steady state radiation dose of about 162 (in arbitrary units) is about 8%. FIG. 10 shows the remaining instability of the accelerator system 100 that included the electric power compensation circuit 114 of FIGS. 4 and 5, during a 300 second time period after a cold start, in which the power is on and a radiation beam is generated. Here, the dose instability was only about 2%.

Figure 11:
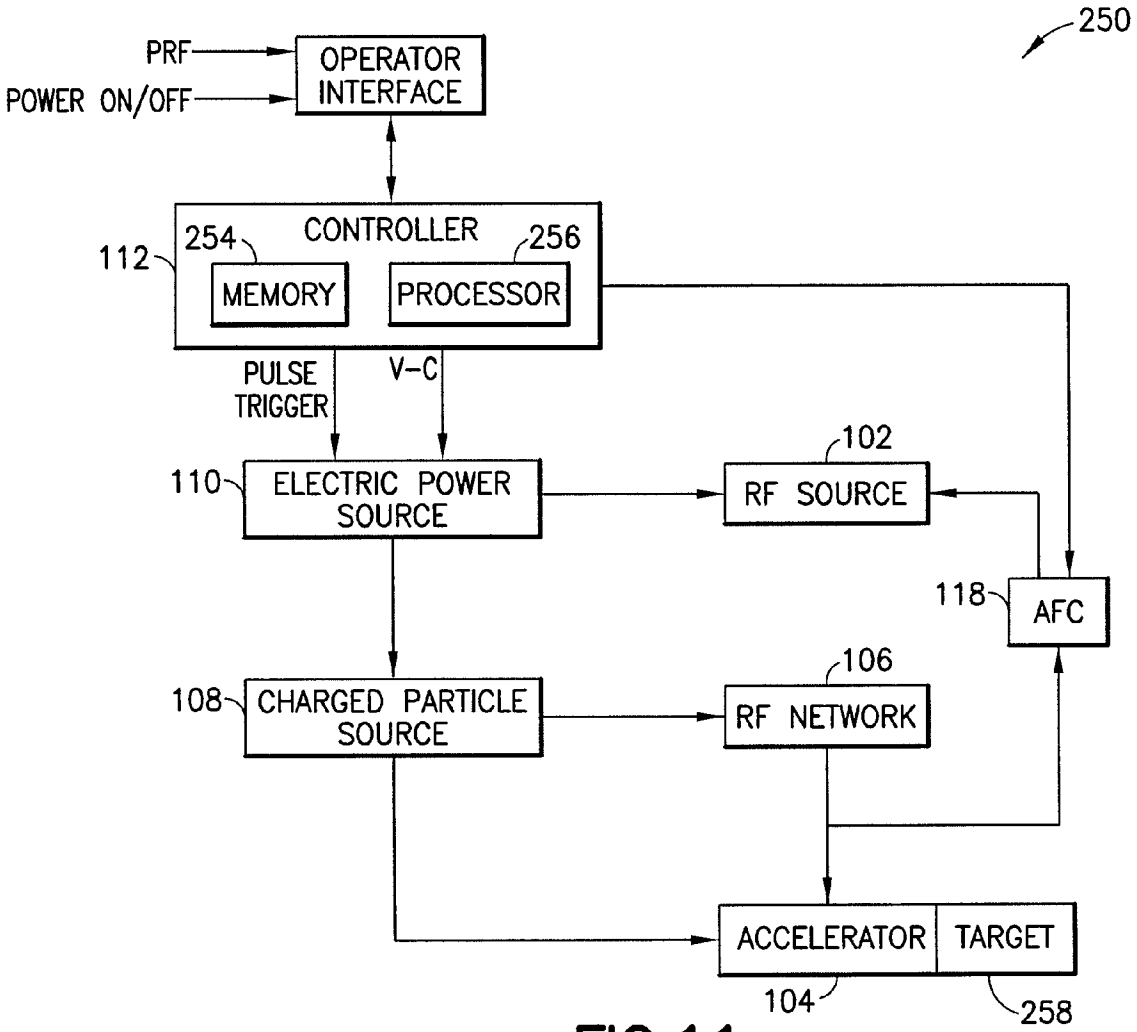
FIG. 11 is an example of a block diagram of an accelerator including electric power compensation controlled by a software program, in accordance with an embodiment of the invention.

Instead of providing a circuit, such as the compensation circuit 114, to adjust the electric power provided by the electric power supply 110 to the RF source 102 and the charged particle source 108, the controller 24 may be programmed by software to compensate for the difference between the target dose and/or energy and the expected dose and/or energy due to instabilities. FIG. 11 is an example of a block diagram of a system 250, where a controller 252 comprises a memory 254 to store a software program 255 and a processor 256. The memory 254 or other such memory may also store information used by the processor 256 and the software program 255, such as a time constant for the system (determined as described above based on factory and/or on-site testing) and other variables discussed further below. The memory 254 may comprise a suitable combination of RAM and ROM, or other types of memory, for example. The processor 256 may be a central processing unit, a microprocessor, or control circuit, for example. An application specific integrated circuit (ASIC) may also be provided instead of or in addition to the software program 255. In FIG. 11, elements common to FIG. 3 are similarly numbered. The controller 112 sends a pulse trigger and compensated control voltages V-C to the electric power source 110, as discussed above, however in this embodiment the compensated control voltage is determined by software. In the system 240, a target 258 is provided to generate radiation, although that is not required. A target 258 may be similarly provided in the system 100 of FIG. 3. The target 258 may comprise tungsten or other materials that will cause generation of X-ray radiation by the Bremsstrahlung effect upon impact by the charged particles, such as electrons, accelerated by the accelerator 104.

Figure 12:
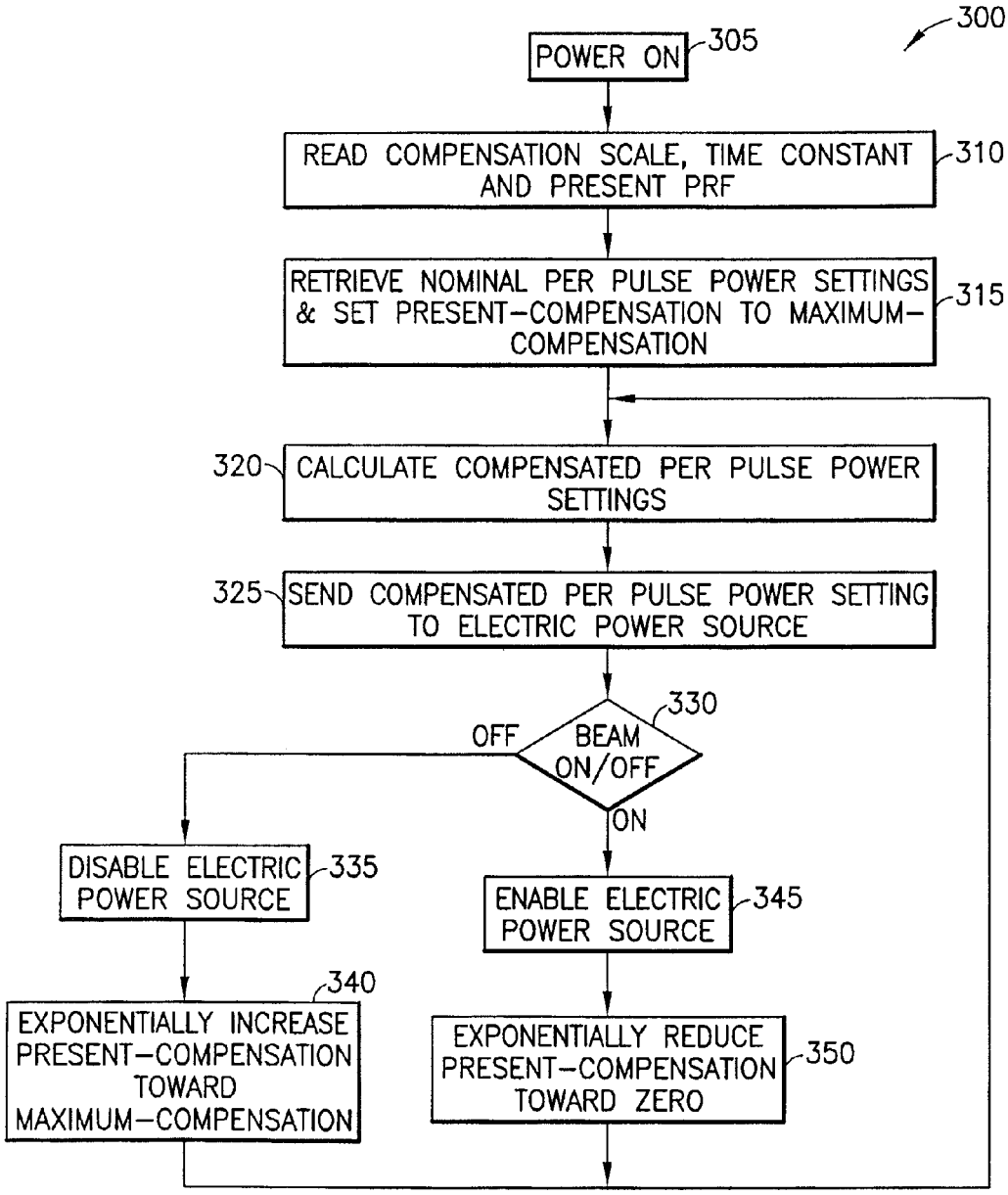
FIG. 12 is an example of a flow chart of a method illustrating how the controller of FIG. 11 may be controlled by the software, in accordance with the embodiment of FIG. 11.

FIG. 12 is an example of a flow chart of a method 300 illustrating how the controller 252 may be controlled by the software program 255 stored in the memory 254, in accordance with an embodiment of the invention. In this example, the software program 255 is configured to provide exponentially decreasing compensated control voltages V-C to the electric power source 110 while the status of the system 250 is beam on, and to exponentially increase the compensated control voltages V-C that will be provided when the system status is changed from beam off to beam on, while the status of the system 250 is beam off.

When the system 250 is initially powered on, power is provided to the controller 252, in Step 305. A compensation scale, compensation time constant, and PRF for the current scanning sequence are read from memory 254 or other such memory, in Step 310. The compensation scale is the maximum percentage adjustment to a nominal power level to be provided by the electric power source 110 to the RF source 102, at the highest PRF at which the system 250 is expected to operate. The nominal power level may be of 20 kilovolts, for example. The compensation scale is set in a factory or by a field service engineer during set up of the system 250 on-site, based on the difference between the target dose and/or energy and the expected dose and/or energy of the system found during test runs.

The compensation time constant is set to the time constant of the dose/energy instability, which is also determined during testing, as described above. The present PRF is the PRF set by the operator for the current scanning sequence. Maximum compensation at the present PRF is calculated by multiplying the nominal per pulse power setting ("nominal ppps") with the retrieved compensation scale ("CS"), and the ratio of the present PRF and the expected highest PRF, which was used to determine the stored compensation scale ((nominal ppps)×(CS)×(present PRF/highest PRF)).

Nominal per pulse power settings are retrieved and present compensation V-comp is set to maximum compensation V-comp for a cold start, in Step 315. The nominal per pulse power setting is the nominal voltage described above with respect to the controller 112.

Compensated per pulse power settings (or compensated control voltages V-C, as referred to above), are calculated in Step 320. The first calculated compensated per pulse power setting V-C is a combination of the nominal per pulse power setting and the maximum compensation V-comp for a cold start, which is retrieved from memory 254 in Step 315. For example, the compensated per pulse power setting V-C may be a sum of the nominal per pulse power setting and maximum compensation V-comp. As above, the maximum compensation V-comp may be subtracted from the nominal per pulse power setting to yield the compensated per pulse power setting V-C. Subsequent compensated per pulse power settings V-C are calculated based on compensation values V-comp determined in subsequent steps of the method, as described below, and stored in a memory location in the memory 255.

The value of the compensated per pulse power setting V-C calculated in Step 320 is stored in a memory location in the memory 254, and is sent to the electric power source 110, in Step 325.

It is then determined whether the status of the system 250 is beam on or beam off, in Step 330. The status of the system may be checked by checking a flag or other such indicator stored in the controller 252 in the memory 254 or in another memory location, for example. If the status of the system is beam off, the electric power supply 110 is disabled or stays disabled, in Step 335, and the present compensation value V-comp stored in the memory 254 is increased exponentially toward a maximum compensation, in Step 340, by an increment, and stored in the memory 254. The increased present compensation value may replace the prior compensation value or may be stored in a different memory location. The incremental increase in this example is equal to $1-e^{-T/\tau}$, where T is the length of time of the increment and $\tau$ is the compensation time constant. For example, if the compensation time constant $\tau$ is set to 25 seconds and the software loop repeats every 0.5 seconds, the difference between the present compensation value and the maximum compensation value is reduced by $1-e^{(0.5/25)}$, which is about 2%.

The method then returns to Step 320 to calculate a present compensated per pulse power setting V-C, based on the new present compensation value from Step 340, which has been stored in the memory 254. If the system status is again found to be beam off in Step 330, then the electric power source 110 stays disabled and the value of present compensation V-comp is exponentially increased again, by an increment calculated as described above, in Step 340. This continues until the system status changes to beam on.

If the system status is found to be beam on in Step 330, then the electric power source 110 is enabled, V-comp is reduced exponentially toward zero by an increment, in Step 350 and stored in a memory location in the memory 254. The method returns to Step 320 to calculate the present compensated per pulse power setting V-C based on the value of the present compensation V-comp, which is stored in a memory location in the memory 255. A voltage corresponding to the compensated per pulse power setting V-C is generated by the controller 112 and sent to the electric power source 110, in Step 325, to cause generation of electric power. The increment may be calculated as described above ($1-e^{-T/\tau}$). The present compensation value V-comp provided to the electric power source 114 is exponentially decreased every 0.5 seconds in this example, while the system status is beam on. The electric power source 110 is enabled or stays enabled to generate the adjusted power and provide the adjusted power to the RF source 102 based on the voltages corresponding to the compensated per pulse power settings V-C calculated as described above, until the system status returns to beam off. As discussed above, during beam off time periods, the present compensation values V-comp are increased exponentially toward maximum compensation, in anticipation of the system status being changed back to beam on. The longer the system status is beam off, the higher the V-comp when the system status changes to beam on again. This is consistent with the need for greater instability compensation the longer the system status is beam off, as described above.

In another software implementation, required compensation over the course of a scanning sequence may be stored in a table and correlated with time and scanning sequence. The values are retrieved at appropriate times as the scanning sequence progresses.

The flowchart of FIG. 12 is an example of a software implementation of an embodiment of the invention. Other software implementations may be developed in accordance with the teachings herein, that would be encompassed by the claims, below.

In an alternative embodiment, a predetermined constant compensation may be for a predetermined period of time to decrease instabilities, based on the past performance of the system.

In other examples, the RF source 102 may be configured to provide RF power to the accelerator that compensates for dose and/or energy instabilities, based on the past performance of the system 100. The RF source may provide the RF power based on the electric power provided by the electric power source, as discussed above, or by other methods.

Although the above description refers to a steady state RF accelerator based radiation source where all pulses are the same, the embodiments of the invention described above also apply to multi-energy accelerator systems, where characteristics of the radiation pulses vary, as described in U.S. Pat. No. 8,183,801 B2, which is identified above and is incorporated by reference herein. It is also applicable to variable dose output accelerators. In this case, the target dose/energy changes over time, and the goal of the compensation is to follow the changing target.

One of ordinary skill in the art will recognize that other changes may be made to the embodiments described above without departing from the spirit and scope of the invention, which is defined by the claims below.

We claim:

1. A stabilized radio-frequency ("RF") accelerator system, comprising:

an RF accelerator to accelerate charged particles;

an RF source coupled to the accelerator to provide RF power into the accelerator;

a charged particle source coupled to the accelerator to inject charged particles into the accelerator;

an electric power source coupled to the RF source and the charged particle source to provide electric power thereto; and a controller coupled to the electric power source to control operation of the electric power source, the controller configured to generate a compensated control voltage based, at least in part, on a nominal control voltage and a compensation voltage, and to provide the compensated control voltage to the electric power source, the compensation voltage compensating for dose and/or energy instability in the respective acceleration system;

wherein:

the electric power provided to the RF source by the electric power source is based, at least in part, on the compensated control voltage; and the compensated control voltage is based, at least in part, on past performance of the system determined by testing of the system.

2. The system of claim 1, wherein the controller is configured to determine a present compensated control voltage during a beam on time period by:

decreasing a prior compensated control voltage from a first value to the present compensation control voltage during a beam on time period; and the controller is further configured to:

provide the present compensated control voltage to the electric power source during the beam on time period.

3. The system of claim 2, wherein the controller is further configured to determine a present compensated control voltage during a beam off time period by:

increasing a prior compensated control voltage from a first value to the present compensation control voltage; and the controller is further configured to:

provide the present compensated control voltage to the electric power source during the beam on time period.

4. The system of claim 3, wherein the nominal control voltage is stored by the system and the controller is configured to determine the present compensated control voltage by:

retrieving the nominal control voltage stored by the system; and adjusting the retrieved nominal control voltage value by a compensation value, determined by:

exponentially decreasing a prior compensation value to the present compensation value during a beam on time period; and/or exponentially increasing the prior compensation value toward a maximum compensation value, to the present compensation value, during a beam off time period.

5. The system of claim 4, wherein the controller is configured to determine the compensation value by a compensation circuit.

6. The system of claim 5, wherein the compensation circuit comprises an R-C circuit comprising:

a capacitor; and a resistor;

wherein the R-C circuit is configured such that the capacitor discharges during the beam on time period, providing exponentially decreasing present compensation values to the electric power source during beam on time periods, based, at least in part, on a respective current voltage of the capacitor during the beam on time period.

7. The system of claim 6, wherein:

the compensation circuit further comprises a second R-C circuit comprising:

the capacitor; and a second resistor;

wherein the second R-C circuit is configured such that the capacitor charges exponentially toward a maximum voltage during beam off time periods.

8. The system of claim 7, wherein the compensation circuit further comprises:

a diode between the second resistor and the capacitor;

an input to provide a reference voltage to charge the capacitor through the second resistor and the diode, during beam off time periods;

a first ground, wherein the capacitor discharges to the first ground through the first resistor during beam on time periods;

an inverting attenuator coupled to the capacitor to invert and attenuate the current voltage of the capacitor during the beam on time period, wherein the present compensation value is an output of the inverting attenuator; and a second ground between the second resistor and the diode, wherein the reference voltage selectively discharges to the second ground through the second resistor during the beam on time periods.

9. The system of claim 8, wherein the reference voltage is based, at least in part, on a pulse repetition frequency of a generated beam during respective beam on time periods.

10. The system of claim 9, further comprising:

a first switch to selectively couple the capacitor to the first ground through the first resistor during beam on time periods, to allow the capacitor to discharge to the first ground; and a second switch to selectively couple the second resistor to the second ground during beam off time periods, to allow current in the second resistor to flow to the second ground;

wherein the first switch and the second switch are controlled by the controller.

11. The system of claim 8, wherein;

the first resistor is a variable resistor; and the second resistor is a variable resistor.

12. The system of claim 6, wherein the RC circuit has a time constant based, at least in part, on the past performance of the system.

13. The system of claim 12, wherein the second R-C circuit has a second time constant based, at least in part, on the past performance of the system to exponentially increase the charge of the capacitor toward a maximum voltage.

14. The system of claim 12, wherein;

the first resistor is a variable resistor;

the second resistor is a variable resistor; and the first and second time constants are set, at least in part, by setting the resistances of the first and second variable resistors, respectively.

15. The system of claim 4, further comprising:

memory;

wherein the controller is configured to determine the present compensation value by software stored in the memory.

16. The system of claim 15, wherein the controller is configured by the software to:

periodically adjust a nominal control voltage value by a compensation value, wherein the compensation value is determined by:

periodically determining whether the status of system is beam on or beam off;

if the determined status is determined to be beam on, exponentially decrease the prior compensation value to a present compensation value by an increment based, at least in part, on a time period and an instability time constant based, at least in part, on past performance of the system; and if the determined status is determined to be beam off, exponentially increase the present compensation value by an increment toward a maximum value, based, at least in part, on a time period and an instability time constant based, at least in part, on the past performance of the system.

17. The system of claim 16, wherein the software is configured to cause the controller to:

provide a maximum compensation value at a start of a first beam on period upon a cold start; and determine the present compensation value by exponentially decreasing the maximum compensation value to the present compensation value.

18. The system of claim 1, further comprising:

a target material positioned to be impacted by accelerated charged particles.

19. A method of operating a charged particle acceleration system, comprising:

injecting charged particles into an RF accelerator;

generating a compensated control voltage based, at least in part, on a nominal control voltage and a compensation voltage, the compensation voltage compensating, at least in part, for dose and/or energy instability in the respective acceleration system, the compensation voltage being based, at least in part, on past performance of the system determined by testing of the system;

providing RF power to the accelerator, the RF power being based, at least in part, on the compensated control voltage; and accelerating the injected charged particles by the accelerator.

20. The method of claim 19, further comprising:

providing the compensated control voltage to a source of electric power; and providing electric power to an RF source, the electric power being based, at least in part, on the compensated control voltage.

21. A charged particle acceleration system, comprising:

accelerator means for accelerating charged particles;

means for injecting charged particles into the accelerating means;

RF power means for providing RF power to the acceleration means;

electric power means for providing electric power to the RF power means; and control means for controlling operation of the electric power means based, at least in part, on past performance of the system determined by testing of the system, to compensate, at least in part, for dose and/or energy instability.

22. The system of claim 21, wherein:

the RF power provided to the accelerator by the RF power means is based, at least in part, on the electric power provided by the electric power means.

23. The system of claim 15, wherein the memory is part of the controller.

24. The method of claim 20, wherein generating the compensated control voltage comprises:

determining a present compensated control voltage to provide to an electric power source coupled to the RF source during a beam on time period;

providing the present compensated control voltage to the electric power source during the beam on time period; and providing the compensated electric power to the RF source by the electric power source during the beam on time period.

25. The method of claim 24, comprising:

determining the present compensated control voltage by:

decreasing a prior compensated control voltage from a first value to the present compensation control voltage during a beam on time period.

26. The method of claim 24, comprising:

determining the present compensated control voltage during a beam off time period by:

increasing a prior compensated control voltage from a first value to the present compensation control voltage.

27. The method of claim 24, comprising determining the present compensated control voltage by:

retrieving a nominal control voltage stored by the system; and adjusting the retrieved nominal control voltage value by a compensation value, determined by:

exponentially decreasing a prior compensation value to the present compensation value during a beam on time period; and/or exponentially increasing the prior compensation value toward a maximum compensation value, to the present compensation value, during a beam off time period.

28. The method of claim 24, comprising determining the compensation value by a compensation circuit.

29. The method of claim 24, comprising determining the present compensation value by software stored in a memory.

* * * * *